US008684710B2

(12) United States Patent
Jingzhi et al.

(10) Patent No.: US 8,684,710 B2
(45) Date of Patent: Apr. 1, 2014

(54) DISTRIBUTOR ASSEMBLY FOR TWO-SPEED GEROTOR DEVICE

(75) Inventors: Yan Jingzhi, Jiangsu (CN); Li Linhua, Jiangsu (CN); Shi Qingguo, Jiangsu (CN)

(73) Assignee: White (China) Drive Products Co., Ltd., Jiangsu (CN)

( * ) Notice: Subject to any disclaimer, the term of this patent is extended or adjusted under 35 U.S.C. 154(b) by 0 days.

(21) Appl. No.: 13/695,644

(22) PCT Filed: Dec. 7, 2010

(86) PCT No.: PCT/CN2010/079534
§ 371 (c)(1), (2), (4) Date: Nov. 1, 2012

(87) PCT Pub. No.: WO2012/075625
PCT Pub. Date: Jun. 14, 2012

(65) Prior Publication Data
US 2013/0149181 A1 Jun. 13, 2013

(51) Int. Cl.
*F04B 7/00* (2006.01)
*F01C 1/10* (2006.01)
*F16K 5/10* (2006.01)

(52) U.S. Cl.
USPC ..... 417/510; 418/171; 251/208

(58) Field of Classification Search
USPC ..... 418/171; 251/205, 206, 208
See application file for complete search history.

(56) References Cited

U.S. PATENT DOCUMENTS 2,148,561 A * 2/1939 Kempton et al. ..... 418/32
3,687,581 A 8/1972 Easton
4,480,971 A 11/1984 Swedberg
4,549,579 A * 10/1985 Bergmann ..... 137/625.21
4,715,798 A 12/1987 Bernstrom
5,061,160 A 10/1991 Kinder et al.
5,137,438 A 8/1992 Miller
5,417,083 A * 5/1995 Eber ..... 62/528
5,934,320 A * 8/1999 O'Reilly et al. ..... 137/625.21
(Continued)

FOREIGN PATENT DOCUMENTS

EP 0276680 8/1988

OTHER PUBLICATIONS

International Search Report filed in PCT/CN2010/079534, mailed Sep. 15, 2011.

*Primary Examiner* — Charles Freay
(74) *Attorney, Agent, or Firm* — Rankin, Hill & Clark LLP

(57) ABSTRACT

A distributor assembly (12) includes a distributor housing (102) and a valve selector plate (104). The distributor housing (102) includes an axial bore (106) extending in an axial direction through the distributor housing. The valve selector plate (104) is disposed in the axial bore (106) and is rotatable around a rotational axis (130) parallel to the axial direction between a first orientation and a second orientation. The valve selector plate (104) includes a first substantially planar face (132), a second substantially planar face (134), axial passages (136) radially offset from the rotational axis (130) and extending through the valve selector plate (104) from the first face (132) to the second face (134), and at least one fluid blocking section (138) configured to block axial flow through the distributor assembly. Each fluid blocking section (138) is interposed between and radially aligned with the axial passages (136) with respect to the rotational axis (130). A two-speed gerotor motor is also disclosed.

10 Claims, 4 Drawing Sheets

(56) References Cited

U.S. PATENT DOCUMENTS

| | | | | |
|---|---|---|---|---|
| 6,068,460 | A | 5/2000 | Haarstad et al. | |
| 6,099,280 | A | 8/2000 | Bernstrom et al. | |
| 6,544,018 | B2 * | 4/2003 | Heckel et al. | 418/61.3 |
| 6,679,691 | B1 | 1/2004 | Barto et al. | |
| 6,827,562 | B1 | 12/2004 | Barto | |
| 7,695,259 | B2 | 4/2010 | Miller | |

* cited by examiner

DISTRIBUTOR ASSEMBLY FOR TWO-SPEED GEROTOR DEVICE

TECHNICAL FIELD

The present invention relates to gerotor devices, and particularly to a distributor assembly for two-speed gerotor device.

BACKGROUND ART

Gerotor devices can be used in a variety of applications, one of the most common being to use the device in a low-speed, high-torque (LSHT) motor. Some gerotor devices can also be used in a high-speed, low-torque (HSLT) mode of operation. One example of a two-speed gerotor motor, one in which the motor is capable of operating in a LSHT mode of operation and an HSLT mode of operation, provides valving in the motor to recirculate fluid between expanding and contracting fluid pockets of a gerotor gear set, hereinafter referred to as a rotor set. In such a motor, if the inlet port of the motor communicates with all of the expanding pockets, and all of the contracting pockets of the rotor set communicate with the outlet port, the motor operates in a normal LSHT mode. To operate this known motor in the HSLT mode, the number of the contracting pockets and the expanding pockets is less than the LSHT mode.

Multiple speed gerotor motors have also been developed that include multiple rotor sets. Such a motor includes a first rotor set and a second rotor set, each defining a plurality of expanding and contracting fluid pockets. A selector valve is disposed between the first and second rotor sets. The motor is operable in an LSHT mode in which fluid flows from the fluid pockets in the first rotor set, then through the selector valve, then through the fluid pockets in the second rotor set. In an HSLT mode of operation, fluid out of the fluid pockets in the first rotor set is blocked by the selector valve, and fluid in the fluid pockets in the second rotor set flows through the selector valve to a case drain.

The two-speed gerotor motors that employ only one rotor set typically employ complicated valving mechanisms to change the number of expanding and contracting pockets. Alternatively, in two-speed gerotor motors where only one rotor set is employed, large end caps and valving mechanisms are employed making the motor much longer in an axial direction as compared to gerotor motors that operate in only the LSHT mode of operation. The hydraulic motors that employ more than one rotor set are also much longer than typical hydraulic motors that operate only in the HSLT mode of operation, and even longer than two-speed motors with one rotor set. These motors also include an additional rotor set, which can add significantly to the cost of the motor.

DISCLOSURE OF INVENTION

Technical Problem

A distributor assembly is disclosed for a two-speed gerotor device that can overcome at least one of the aforementioned shortcomings.

Technical Solution

The distributor assembly includes a distributor housing and a valve selector plate. The distributor housing includes an axial bore extending in an axial direction through the distributor housing. The valve selector plate is disposed in the axial bore and is rotatable about a rotational axis parallel to the axial direction between a first orientation and a second orientation. The selector plate includes a first substantially planar face, a second substantially planar face, axial passages radially offset from the rotational axis and extending through the selector plate from the first face to the second face, and at least one fluid blocking section configured to block axial flow through the distributor assembly. Each fluid blocking section is interposed between and radially aligned with the axial passages with respect to the rotational axis.

Advantageous Effects

A two-speed gerotor motor that can overcome at least one of the aforementioned shortcomings includes a rotor set including a stator and a rotor rotating and orbiting with respect to the stator to define n+1 expanding and contracting fluid pockets. The motor further includes an output shaft operably connected with the rotor of the rotor set, a commutator valve operably connected with the rotor for rotation with the rotor, and the aforementioned distributor assembly disposed between the rotor set and the commutator valve. The commutator valve includes a plurality of valve passages for providing fluid to and receiving fluid from the fluid pockets.

MODE FOR INVENTION

Figure 1:
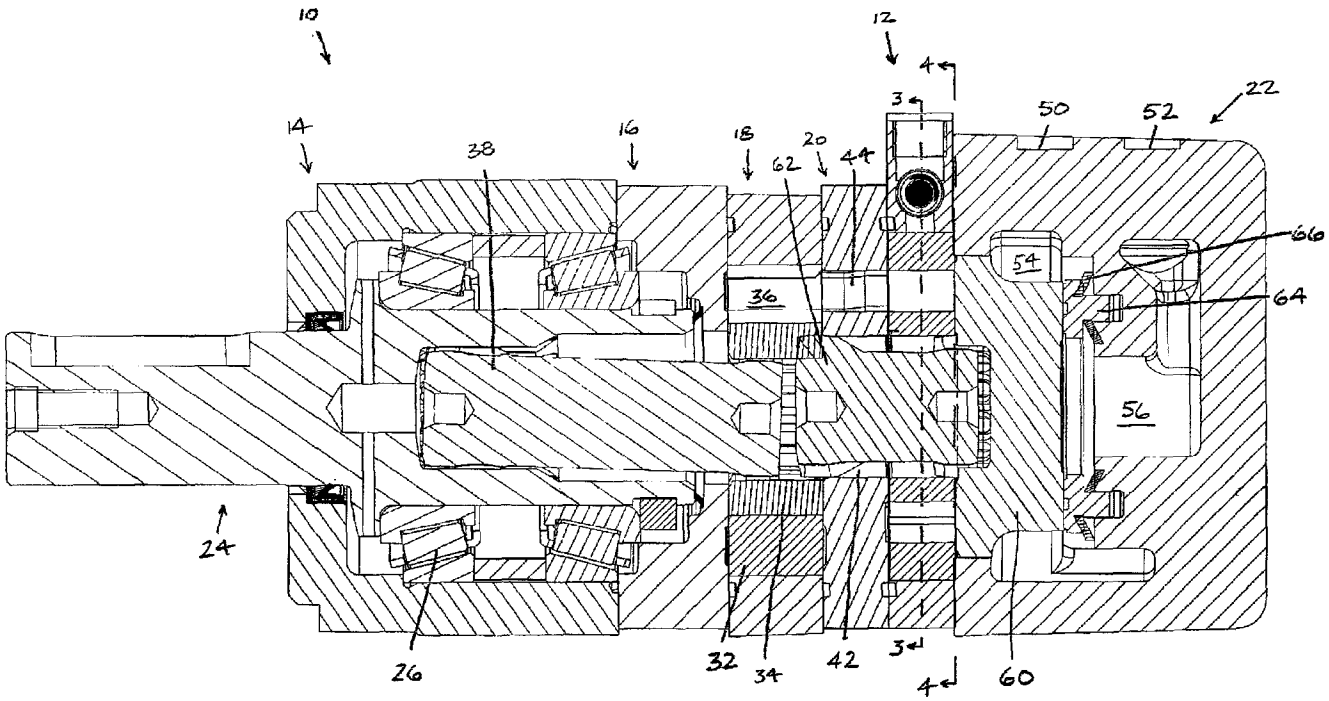
FIG. 1 is an axial cross-section of a two-speed gerotor motor, including a distributor assembly for operating the motor in two modes of operation.

FIG. 1 depicts a hydraulic motor 10 that is similar in configuration to a WS Series motor available from White Drive Products, Inc., of Hopkinsville, Ky., U.S.A., with the exception of the addition of a distributor assembly 12, which will be described in more detail. The hydraulic motor 10 generally includes a housing 14, a wear plate 16, a rotor set 18, a manifold 20, and an end cap 22, in addition to the distributor 12. An output shaft 24 rides on a bearing assembly 26 within the housing 14 and includes an extension 28 that extends outwardly from the housing. The wear plate 16 is interposed between and connected to the housing 14 and rotor set 18. The rotor set 18 includes a stator 32, which can include rollers, and a rotor 34 rotating and orbiting with respect to the stator to define expanding and contracting fluid pockets 36 as the rotor rotates and orbits with respect to the stator. The output shaft 24 operably connects with the rotor 34 via a main drive link 38. The manifold 20 is interposed between and connects to the rotor set 18 and the distributor assembly 12. The manifold 20 includes a central hole 42 that extends through the manifold in an axial direction and a plurality of axial manifold passages 44 radially offset from the central hole 42. The number of axial manifold passages 44 in the manifold 20 connected with the fluid pockets 26 is equal to the number of expanding and contracting fluid pockets 36, and as typical in known gerotor motors, n+1 fluid pockets 36 are defined by the rotor set 18.

The end cap 22 includes fluid ports 50 and 52. The first fluid port 50 connects with an annular passage 54 formed in the end cap 22. The second fluid port 52 connects with a fluid cavity 56 also formed in the end cap 22. A rotating commutator valve 60 is positioned in the end cap 22 and operably connects with the rotor 34 via a valve drive link 62 for rotation with the rotor. The commutator valve 60 includes a plurality of valve passages (not visible) for communication with the fluid pockets 36 defined by the rotor set 18. A piston 64 biased by springs 66 biases the commutator valve 60 toward the distributor assembly 12. Fluid enters one of the fluid ports 50 or 52 and exits the other of the fluid ports resulting in rotating and orbital movement of the rotor 34 with respect to the stator 32, which results in rotational movement of the output shaft 24.

Figure 2:
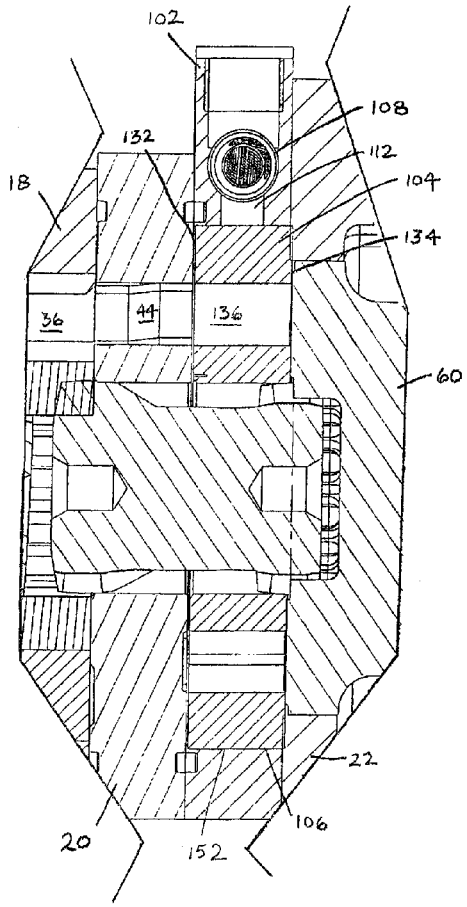
FIG. 2 is an axial cross-section similar to FIG. 1 depicting a portion the two-speed gerotor motor including the distributor assembly.

The distributor assembly 12 allows the gerotor motor 10 to switch between an LSHT mode of operation and an HSLT mode of operation. With reference to FIG. 2, the distributor assembly 12 includes a distributor housing 102 and a valve selector plate 104 disposed in the distributor housing. The distributor housing 102 includes an axial bore 106 extending in the axial direction through the distributor housing. As more clearly seen in FIG. 3, the axial bore 106 is circular in a cross-section taken normal to the axial direction. With reference back to FIG. 2, the distributor housing 102 also includes a transverse bore 108 that extends through the distributor housing 102 in a direction that is transverse to the axial direction. In the illustrated embodiment and as more clearly seen in FIG. 3, the transverse bore 108 extends through the distributor housing 102 in a direction that is perpendicular to the axial direction. The distributor housing 102 also includes a cavity 112 connected with the transverse bore 108 and the axial bore 106. As more clearly seen in FIG. 3, the cavity 112 is defined by a first stop surface 114 and a second stop surface 116 spaced from the first stop surface in a direction that is transverse to the axial direction. The distributor housing 102 also includes a first port 118, which operates as a pilot pressure port that will be described in more detail below, and a second port 122. Each port 118, 122 connects with the transverse bore 108. With continued reference to FIG. 3, the distributor housing 102 also includes bolt holes 124 that are radially spaced from the axial bore 104 and that are configured to receive bolts for connecting the distributor housing 102 to the end cap 22 and the manifold 20.

Figure 3:
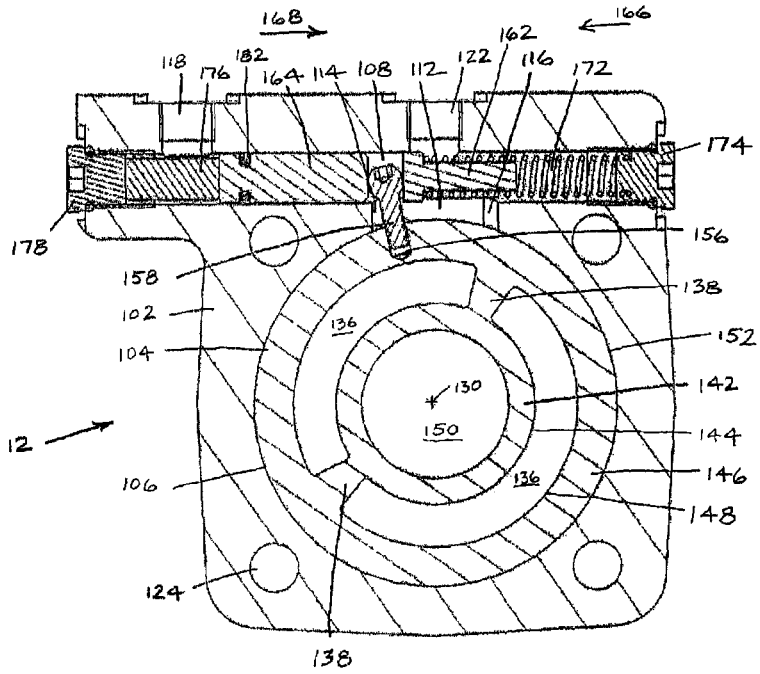
FIG. 3 is a cross-sectional view taken along line 3-3 in FIG. 1 showing the distributor assembly in a first mode of operation.

The valve selector plate 104 is disposed in the axial bore 106 of the distributor housing 102 and is rotatable about a rotational axis 130, which in the depicted embodiment is coincident with the rotational axis of the output shaft 24. With reference back to FIG. 2, the valve selector plate 104 includes a first (forward) substantially planar face 132 and a second (rear) substantially planar face 134 opposite the first face. The first face 132 faces toward the manifold 20 and the second face 134 faces toward the end cap 22. With reference to FIG. 3, axial passages 136 (two axial passages are illustrated) are radially offset from the rotational axis 130 and extend through the valve selector plate 104 from the first face 132 to the second face 134. The axial passages 136 are configured to permit fluid communication to and from the fluid pockets 36 defined by the rotor set 18 through the distributor assembly 12. As illustrated in FIG. 3, the axial passages 136 are generally C-shaped having a height, measured parallel with a radius emanating from the rotational axis 130, that is generally equal to the height, which is also measured parallel with a radius emanating from the rotational axis 130, of the axial manifold passages 44 (see FIG. 2).

With reference to FIG. 3, a fluid blocking section 138 (two fluid blocking sections are illustrated) is on and/or parallel with at least one of the planar faces 132, 134 and is radially offset from the rotational axis 130. Each fluid blocking section 138 is interposed between and radially aligned with the axial passages 136 with respect to the rotational axis 130. Each fluid blocking section 138 extends in an axial dimension from the first face 132 to the second face 134 of the valve selector plate 104.

Figure 4:
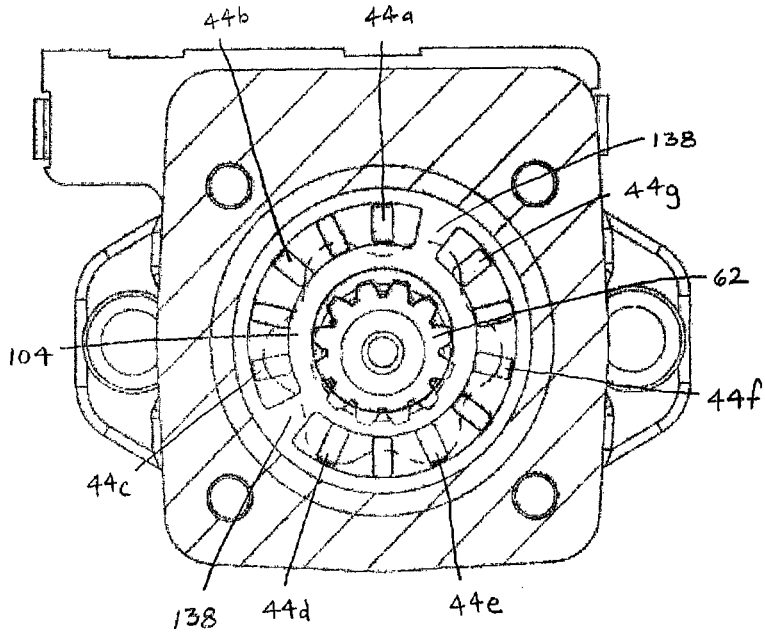
FIG. 4 is a cross-sectional view taken along line 4-4 in FIG. 1 showing the distributor assembly in the first mode of operation.
Figure 5:
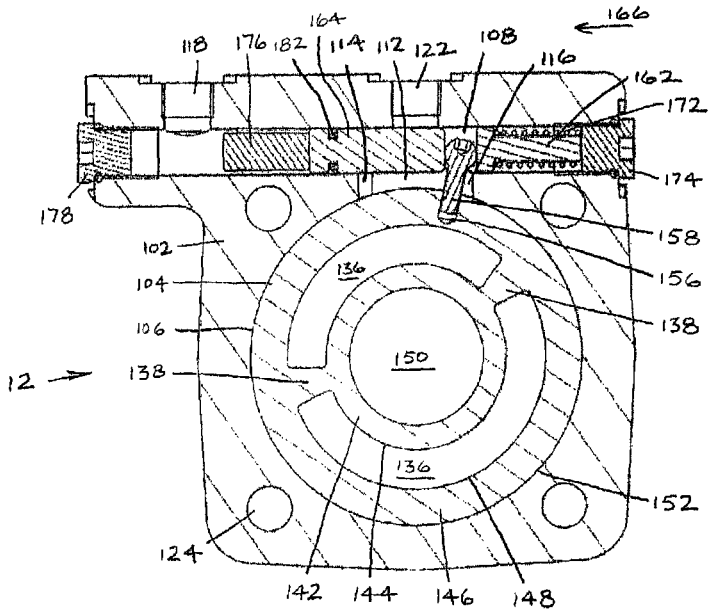
FIG. 5 is a cross-sectional view taken along line 3-3 in FIG. 1 showing the distributor assembly in a second mode of operation.
Figure 6:
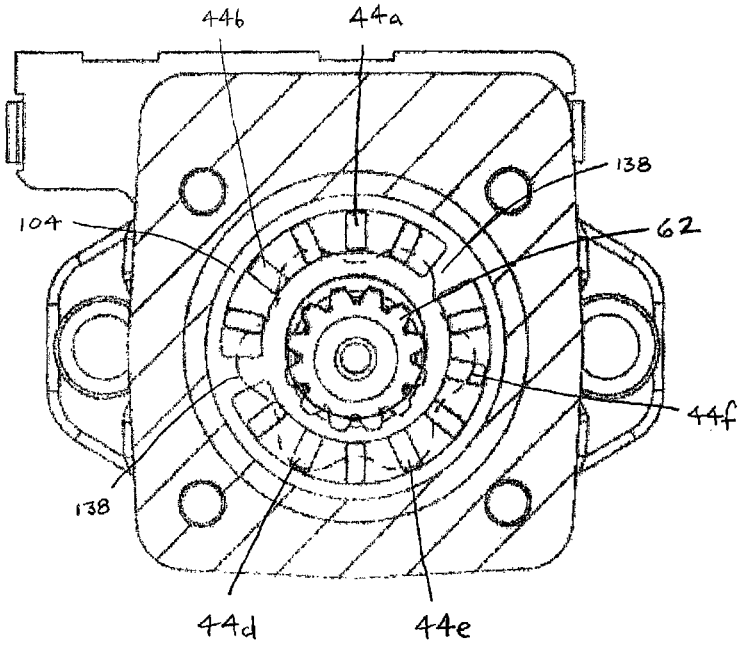
FIG. 6 is a cross-sectional view taken along line 4-4 in FIG. 1 showing the distributor assembly in the second mode of operation.

The valve selector plate 104 is rotatable between a first orientation, which is shown in FIGS. 3 and 4, and a second orientation, which is shown in FIGS. 5 and 6. In a first operating position, which is shown in FIGS. 3 and 4, the valve selector plate 104 can permit generally axial flow through the axial passages 136 to or from n+1 fluid pockets 36 defined by the rotor set 18 and a respective valve passage (not shown) in the commutator valve 60. In the second operating position which is shown in FIGS. 5 and 6, the fluid blocking section 138 can block generally axial flow through the distributor assembly 12 to or from two of the fluid pockets 36. In the particular embodiment depicted, in the second operating position, the fluid blocking section 138 blocks fluid communication between two of the fluid pockets 36 in the rotor set 18 and a respective valve passage (not shown) in the commutator valve 60 such that n−1 fluid pockets 36 are each in communication with a respective valve passage (not shown) in the commutator valve 60.

For the specific embodiment depicted, the rotor set 18 defines seven expanding and contracting fluid pockets 36. In the first operating position, the valve selector plate 104 permits fluid communication between all seven fluid pockets 36 in the rotor set 18 and a respective valve passage (not shown) in the commutator valve 60. As seen in FIG. 4, seven axial manifold passages 44*a*-44*g* remain unblocked to allow fluid communication between all seven fluid pockets 36 in the rotor set 18 and a respective valve passage (not shown) in the commutator valve 60. In the second operating position, the two fluid blocking sections 138 block fluid communication between two of the fluid pockets 36 in the rotor set 18 and two respective valve passages (not shown) in the commutator valve 60. As such, for the specific embodiment depicted, when in the second operating position the valve selector plate 104 permits fluid communication between only five fluid pockets 36 in the rotor set 18 and a respective valve passage (not shown) in the commutator valve 60. With reference to FIG. 6, two axial manifold passages, i.e. axial manifold passages 44*c* and 44*g*, are blocked while axial manifold passages 44*a*, 44*b*, 44*d*, 44*e* and 44*f* are unblocked. With the flow rate through the rotor set remaining constant between the first operating position and the second operating position, the gerotor motor 10 operates in a LSHT mode with the valve selector plate 104 in the first operating position and the gerotor motor operates in a HSLT mode, due to a decrease in the displacement of the rotor set 18, with the valve selector plate 104 in the second operating position.

With reference to FIG. 3, the valve selector plate 104 is circular in a cross-section taken normal to the axial direction, which is perpendicular to the rotational axis 130. In the illustrated embodiment, each of the fluid blocking sections 138 is located on a same side of a diameter of the valve selector plate 104. With continued reference to FIG. 3, the depicted valve selector plate 104 includes an inner annular section 142 defining an inner edge 144 of the axial passages 136 and an outer annular section 146 defining an outer edge 148 of the axial passages 136. The fluid blocking sections 138 bridge from the inner annular section 142 to the outer annular section 146.

With reference back to FIG. 1, the valve selector plate 104 includes a central hole 150 extending through the valve selector plate in an axial direction from the first face 132 to the second face 134. As more clearly seen in FIG. 1, the valve drive link 62 (not shown in FIGS. 3 and 5) connecting the commutator valve 60 to the rotor 34 extends through the central hole 150 in the valve selector plate 104. With reference back to FIG. 2, the central hole 150 is concentric with the rotational axis 130 and is circular in a cross-section taken normal to the axial direction, which is parallel to the rotational axis 130. The inner annular section 142 immediately surrounds the central hole 150. The axial passages 136 are radially disposed between the inner annular section 142 and the outer annular section 146. The outer annular section 146 extends from the axial passages 136 to a generally cylindrical perimeter edge surface 152 of the valve selector plate 104. The valve selector plate 104 also includes a link cavity 156 extending radially inwardly from the outer cylindrical surface 152. The link cavity 156 is configured to receive a link 158 to connect to the valve selector plate 104 for facilitating rotation of the valve selector plate about the rotational axis 130.

The distributor assembly 12 also includes a first piston 162 disposed in the transverse bore 108 and a second piston 164 disposed in the transverse bore. The first piston 162 contacts the link 158 and pushes the link in a first direction 166, the second piston 164 contacts an opposite side of the link 156 and is movable in a second direction 168, which is opposite the first direction. A spring 172 located in the transverse bore 108 acts against a first plug 174, which threads into the transverse bore, to urge the first piston 162 in the first direction 166. The second piston 164 is hollow and is received on a spacer 176 inside the transverse bore 108. The spacer 176 contacts a second plug 178, which is threaded into the transverse bore 108. A seal 182 surrounds the second piston 164 to contact the distributor housing 102 within the transverse bore 108. Pilot pressure from a fluid source enters the first port 118 to urge the second piston 164 in the second direction 168 against the biasing force of the spring 172 to rotate the valve selector plate in a counterclockwise direction per the orientation shown in FIG. 2.

With the distributor assembly 12 shown in the orientation depicted in FIGS. 3 and 4, the gerotor motor 10 operates in the LSHT operation mode. With the distributor assembly 12 shown in the orientation depicted in FIGS. 5 and 6, the gerotor motor 10 operates in the HSLT operation mode. This is accomplished in the following manner.

With reference to FIG. 1, the manifold 20, which is disposed between the rotor set 18 and the commutator valve 60, includes n+1 axial manifold passages 44*a*-44*g* each configured to communicate with a respective fluid pocket 36. With the valve selector plate 104 in the first operating position, which is shown in FIGS. 3 and 4, the valve selector plate 104 permits generally axially flow through the distributor assembly 12 to or from each of the n+1 fluid pockets 36 defined by the rotor set 18. Thus, fluid displacement of the rotor set 18 is maximized and the gerotor motor 10 operates in the LSHT operation mode.

With reference to FIG. 6, the fluid blocking sections 138 of the valve selector plate 104 are located with respect to the axial manifold passages 42 to block fluid flow between at least one of the axial manifold passages 42 (as shown two axial manifold passages 44*c* and 44*g* are blocked) and at least one of the pockets 36 of the rotor set 18. The valve selector plate 104 is shown in the second operating position in FIG. 6. With the valve selector plate 104 in the second operating position, the fluid blocking sections 138 are positioned to only allow axial flow through the distributor assembly 12 to or from n−1 fluid pockets 36 between the rotor set 18 and the commutator 60. Thus, fluid displacement of the rotor set 18 is reduced, while the flow rate through the gerotor motor 10 remains the same, and the gerotor motor 10 operates in the HSLT operation mode.

In the illustrated embodiment, the fluid blocking sections 138 each only cover a single respective axial manifold passage 44 with the valve selector plate 104 in the second operating position (shown in FIGS. 5 and 6). With reference to FIG. 3, each axial passage 136 extends along a radial arc such that each axial passage 136 is in fluid communication with more than one valve passage (not shown) of the commutator valve 60 and more than one fluid pocket 36 defined in the rotor set 18 via the axial manifold passages 44. If desired, however, sections (not shown) could be provided that bridge from the inner annular member 142 to the outer annular member 146 to further isolate respective fluid pockets 36 and axial manifold passages 44. These sections would be interposed between and similarly shaped to the fluid blocking sections 138. These sections would extend from the first face 132 to the second face 134 of the valve selector plate 104. These sections, however, would be dimensioned, i.e. have a width measured along a radial arc having a radius emanating from the central axis 130, such that none of the sections would block a respective axial manifold passage 44 when the valve selector plate 104 is in the first operating position or in the second operating position.

With reference back to FIG. 1, each axial manifold passage 44 is radially spaced from a central axis, which is the rotational axis for the output shaft 24, and is axially aligned with a respective pocket 36 of the rotor set 18. This provides a nearly linear path from the axial passages (not shown) in the commutator valve 60 to the fluid pockets 36 in the rotor set 18. As such, the axial passages 136 in the valve selector plate 104 are radially aligned with the axial manifold passages 44 and the fluid pockets 36 defined by the rotor set 18. This allows for a relatively unrestricted fluid path through the distributor assembly 12 when the valve selector plate 104 is in the first operating position.

With continued reference to FIG. 1, the distributor assembly 12 is interposed between the manifold 20 and the commutator valve 60. The commutator valve depicted in FIG. 1 is a rotating disc valve. Nevertheless, the distributor assembly 12 could be disposed on an opposite side of the rotor set (e.g. disposed between the wear plate 16 and the rotor set 18) where the commutator valve is a rotating spool valve associated with the output shaft 24. With reference back to the depicted embodiment, the gerotor motor 10 including the distributor assembly 12 provides a compact gerotor device that can operate in both an HSLT mode of operation and a LSHT mode of operation.

A distributor assembly for a two-speed gerotor device and a gerotor motor including such a distributor assembly have been described above with particularity with reference to the preceding detailed description. Modifications and alterations will occur to those upon reading and understanding the preceding detailed description. The invention is not limited only to the embodiments described above, but is broadly defined by the appended claims and the equivalents thereof.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A two-speed gerotor motor comprising:

a rotor set including a stator and a rotor rotating and orbiting with respect to the stator to define n+1 expanding and contracting fluid pockets;

an output shaft operably connected with the rotor;

a commutator valve operably connected with the rotor for rotation with the rotor, the commutator valve including a plurality of valve passages for providing fluid to and receiving fluid from the fluid pockets; and a distributor assembly disposed between the rotor set and the commutator valve, the distributor assembly comprising:

a distributor housing including an axial bore extending in an axial direction through the distributor housing; and a valve selector plate disposed in the axial bore and being rotatable about a rotational axis parallel to the axial direction between a first orientation and a second orientation, the valve selector plate including a first substantially planar face, a second substantially planar face, axial passages radially offset from the rotational axis and extending through the valve selector plate from the first face to the second face, and at least one fluid blocking section configured to block axial flow through the distributor assembly and interposed between and radially aligned with the axial passages with respect to the rotational axis.

2. The two-speed gerotor motor of claim 1, wherein the valve selector plate is circular in a cross section taken normal to the axial direction and includes an inner annular section defining an inner edge of the axial passages and an outer annular section defining an outer edge of the axial passages, wherein the fluid blocking section bridges from the inner annular section to the outer annular section.

3. The two-speed gerotor motor of claim 1, wherein the valve selector plate includes two axial passages and two fluid blocking sections.

4. The two-speed gerotor motor of claim 1, wherein each fluid blocking section is located on a same side of a diameter of the valve selector plate.

5. The motor of claim 1, wherein the valve selector plate includes two fluid blocking sections and is rotatable between a first operating position to permit generally axially flow through the axial passages to or from n+1 fluid pockets defined by the rotor set and a second operating position where the fluid blocking sections block generally axially flow through the distributor assembly to or from two fluid pockets while permitting generally axially flow through the axial passages to or from n−1 fluid pockets.

6. The motor of claim 5, wherein each axial passage is in fluid communication with more than one valve passage and more than one fluid pocket.

7. The motor of claim 1, further comprising a valve drive link connecting the commutator valve to the rotor, wherein the valve selector plate includes a hole extending through the valve selector plate in an axial direction and the valve drive link extends through the hole.

8. The motor of claim 1, further comprising a manifold disposed between the rotor set and the commutator valve, wherein the manifold includes n+1 axial manifold passages each configured to communicate with a respective fluid pocket, wherein each fluid blocking section of the valve selector plate blocks fluid flow between a respective axial manifold passage and a respective valve passage when the valve selector plate is in the second operating position.

9. The motor of claim 8, wherein each axial manifold passage is radially spaced from a central axis and radially aligned with a respective pocket, wherein the axial passages in the valve selector plate are radially aligned with the axial manifold passages.

10. The motor of claim 8, wherein the distributor assembly is interposed between the manifold and the commutator valve, and the commutator valve is a rotating disk valve.

* * * * *